US005318380A

United States Patent [19]

Murray

[11] Patent Number: 5,318,380

[45] Date of Patent: Jun. 7, 1994

[54] BARNACLE REMOVAL DEVICE FOR BOAT LIFTS

[76] Inventor: Myles N. Murray, 15 Skyline Dr., Chagrin Falls, Ohio 44022

[21] Appl. No.: 873,528

[22] Filed: Apr. 21, 1992

Related U.S. Application Data

[63] Continuation of Ser. No. 413,167, Sep. 26, 1989, abandoned.

[51] Int. Cl.[5] ..... B63C 3/08

[52] U.S. Cl. ..... 405/2; 405/211; 198/494; 114/44

[58] Field of Search ..... 405/1-3, 405/211; 198/494; 114/44, 45, 263; 187/9 E; 104/279, 280

[56] References Cited

U.S. PATENT DOCUMENTS

| | | | |
|---|---|---|---|
| 893,610 | 7/1908 | Devold | 405/2 |
| 1,316,831 | 9/1919 | Clark | 405/2 |
| 1,372,212 | 3/1921 | Wettervik | 104/279 X |
| 2,915,019 | 12/1959 | Tieman | 104/279 |
| 3,088,287 | 5/1963 | Berry | 114/263 X |
| 3,866,539 | 2/1975 | Gasser | 104/279 X |
| 3,905,452 | 9/1975 | Schirmer | 104/279 X |
| 4,641,996 | 2/1987 | Seal | 405/2 |
| 4,832,210 | 5/1989 | Wood | 405/2 X |

FOREIGN PATENT DOCUMENTS

| | | | |
|---|---|---|---|
| 1605830 | 8/1971 | Fed. Rep. of Germany | 104/279 |
| 2103375 | 11/1971 | Fed. Rep. of Germany | 104/279 |
| 1266833 | 10/1986 | U.S.S.R. | 104/279 |
| 28437 | 9/1912 | United Kingdom | 405/2 |

*Primary Examiner*—Randolph A. Reese
*Assistant Examiner*—John Ricci
*Attorney, Agent, or Firm*—Renner, Otto, Boisselle & Sklar

[57] ABSTRACT

A device for removing barnacles from a boat lift including an elevator riding on rails extending into a body of water, characterized by a blade and a mounting adapter connecting the blade to the elevator of the boat lift. The blade is positioned to remove barnacles from a submerged portion of a rail as the elevator traverses the rail.

14 Claims, 3 Drawing Sheets

BARNACLE REMOVAL DEVICE FOR BOAT LIFTS

This is a continuation of copending application Ser. No. 07/413,167 filed on Sep. 26, 1989, now abandoned.

DISCLOSURE

The invention herein described relates in general to boat lifts and accessories therefor and more particularly to a barnacle removal device for a boat lift.

BACKGROUND OF THE INVENTION

Barnacles are a type of shell fish that cement themselves to other objects in the water such as rocks, boats, etc. Barnacle attachment may be almost impossible to prevent, and once attached, the barnacles may be extremely difficult to remove. Needless to say, barnacles and problems they cause may create an almost constant source of inconvenience, not to mention irritation, to boaters.

A boat lift may be used to prevent, among other things, barnacles from attaching to a boat during periods of nonuse. A known boat lift includes an elevator which rides on a pair of rails. The rails are formed from I-beam members each having a web and two flanges. The elevator includes a boat cradle, roller assemblies mounted to the rails for riding thereon, and respective yokes securing the roller assemblies to the boat cradle. Each roller assembly includes rollers positioned on each side of the rail. The lower portions of the rails extend into the water allowing the boat to be raised and lowered from and into the water for storage and use, respectively.

While a boat lift may help minimize barnacle buildup on the boat itself, the creatures do not hesitate to attach to the lower submerged portions of the rails of the boat lift. Barnacles which attach to the inner surfaces of the flanges of the I-beam rails will be crushed when the elevator is lowered into the water. However, the barnacles which build up on the webs of the rails may create problems. Barnacle buildup on the webs may interfere with the movement of the elevator along the rails and the buildup may advance to a point that renders the boat lift inoperable. In the past, it was necessary to periodically perform the unpleasant and time-consuming task of removing the barnacles from the boat lift rails, typically with a chisel and hammer.

SUMMARY OF THE INVENTION

The present invention provides a device for removing barnacles from a boat lift and, more particularly, submerged portions of the rails of the boat lift. The barnacle removal device includes a blade and a mounting adapter for connecting the blade to the elevator of the boat lift at a position adjacent a rail on which the elevator rides. When the elevator traverses the rail, the blade effects removal of barnacles from the rail with a chisel or cutting action. The blade preferably is removably attached to the mounting adapter whereby the blade may be replaced, interchanged, or removed and sharpened.

The foregoing and other features of the invention are hereinafter fully described and particularly pointed out in the claims, the following description of the annexed drawings setting forth in detail a certain illustrative embodiment of the invention, this being indicative, however, of only one of the various ways in which the principles of the invention may be employed.

DETAILED DESCRIPTION OF THE DRAWINGS

Figure 1:
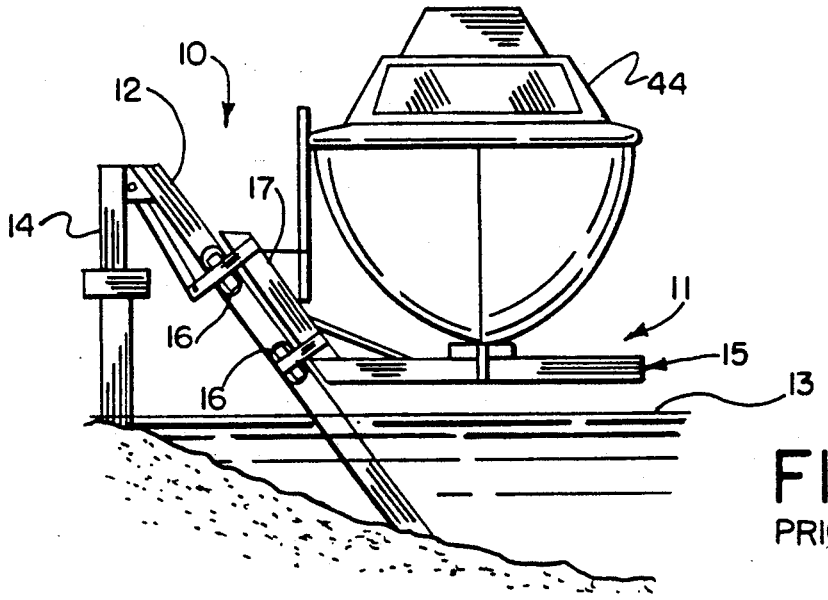
FIG. 1 PRIOR ART
FIG. 1 is a side elevational view of a prior art boat lift.

Referring now to the drawings in detail, and initially to FIG. 1, a conventional boat lift is indicated generally at 10. The boat lift 10 generally includes an elevator 11 and a pair of rails 12 which extend into a body of water 13. Only one of the rails 12 can be seen in FIG. 1, the illustrated rail hiding the other rail from view. The rails are parallel and are located fore and aft of the boat lift. As shown, each rail extends into the water at an approximately 45° incline. The invention, however, is compatible with rails at any angle of incline. Support structure 14 supports the upper end of each rail and the lower end of each rail is anchored by suitable means such as by embedment in the floor of the body of water.

The elevator 11 includes a boat cradle 15 supported by plural roller assemblies 16 on the rails 12 for movement therealong. The boat cradle includes a pair of inclined frame members 17 each associated with a respective one of said rails 12. Each frame member is held parallel and above the respective rail by two roller assemblies 16 respectively located at upper and lower ends of the frame member as shown. The roller assemblies cooperate with the rails to prevent rotation of the boat cradle during raising and lowering of the elevator. Any suitable means may be employed to move the elevator along the rails.

Figure 2:
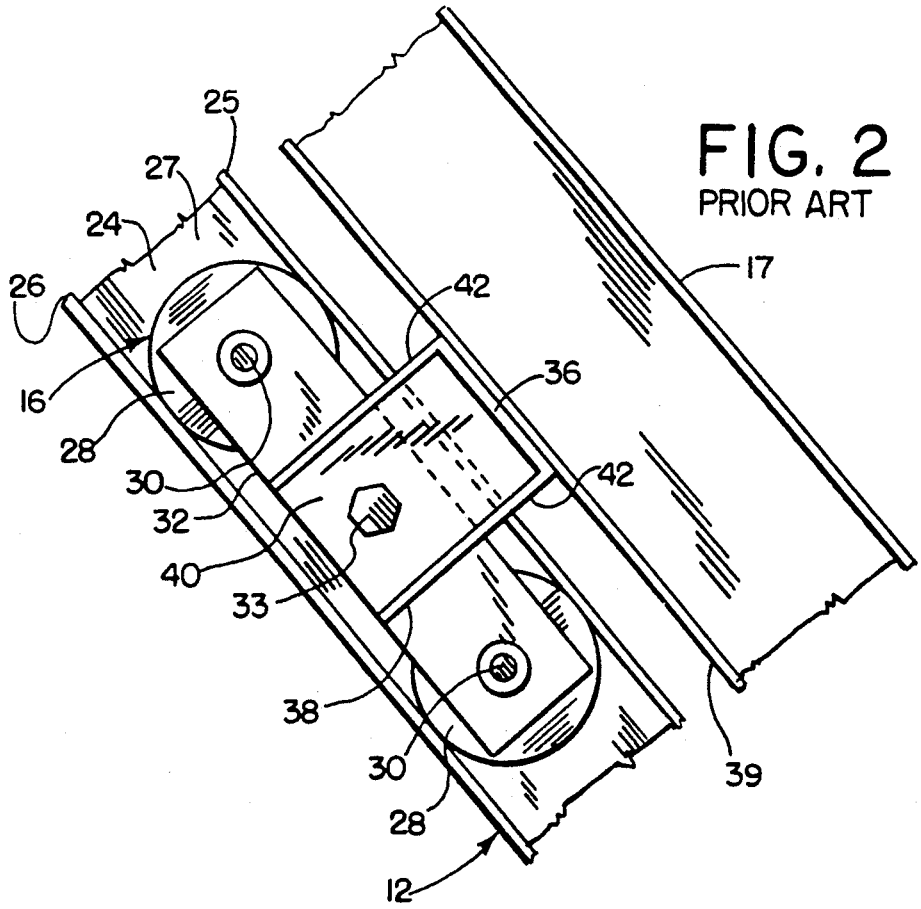
FIG. 2 PRIOR ART
FIG. 2 is an enlargement of a portion of FIG. 1 showing details of a roller assembly employed in the boat lift.
Figure 3:
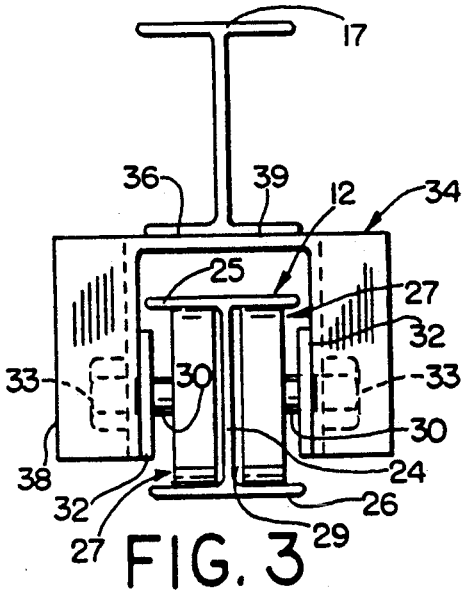
FIG. 3 is an end view of the roller assembly looking from the line 3—3 of FIG. 2.

In the illustrated embodiment the roller assemblies 16 are identical as are the rails 12 and frame members 17. In FIGS. 2 and 3 a representative one of the roller assemblies is shown in relation to its corresponding rail and frame member. As shown, rail 12 is formed by an I-beam having a web 24 connecting top and bottom flanges 25 and 26. The flanges extend from both sides of the web and define therebetween a pair of C-shape channels or tracks 27 extending the operative length of the rail.

Each roller assembly 16 includes four rollers 28, two rollers being positioned in each track 27 at opposite sides of the rail 12. The diameter of each roller 28 is slightly less than the distance between the top and bottom flanges 25 and 26, and a clearance exists between each roller 28 and the web 24 of the rail as seen at 29.

The two rollers 28 in each track 27 are mounted for rotation on axles 30 secured to opposite ends of a rectangular connecting plate 32. Thus, each roller assembly 14 has two connecting plates 32, one on each side of the rail 12.

The two connecting plates 32 are joined by bolts 33 to respective legs of an inverted U-shape yoke 34 which straddles the rail 12. The yoke 34 has a planar top section 36 and two depending side sections 38 forming the legs of the inverted U-shape yoke. The top section 36 is welded or otherwise secured to a bottom flange 39 of the elevator frame member 17. The side sections 38 of the yoke 34 are generally U-shape and each includes a central planar portion 40 and two parallel flanges 42. The flanges 42 extend laterally outwardly from the central planar portion 40 approximately half the width of the top section 36.

The boat lift 10 described above is generally of conventional type. In use, the elevator 11 is lowered into the water for loading of a boat 44 thereon as seen in FIG. 1. When loaded, the elevator is raised to lift the boat out of the water so that barnacles cannot attach themselves to the boat during periods of nonuse. The rails 12, however, do not fare as well as the boat. The lower portion of each rail remains submerged and barnacles over time may accumulate on the surfaces of the rail. Barnacle buildup on the inside surfaces of the flanges 25 and 26 forming the top and bottom of the tracks 27 has not been much of a problem in that when the elevator is lowered the rollers roll over and crush the barnacles. However, buildup of barnacles on the web 24 of the rail may create a serious problem. As the elevator is lowered into the water the barnacles on the web 24 may become jammed in the clearances 29 between the rollers and web and impair movement of the elevator possibly to the point of lock-up and eve damage to the boat lift. In the past it was common practice to periodically perform the unpleasant and time-consuming task of removing the barnacles typically with a chisel and hammer. The present invention provides an advantageous alternative to this task in the form of a barnacle removal device.

Figure 5:
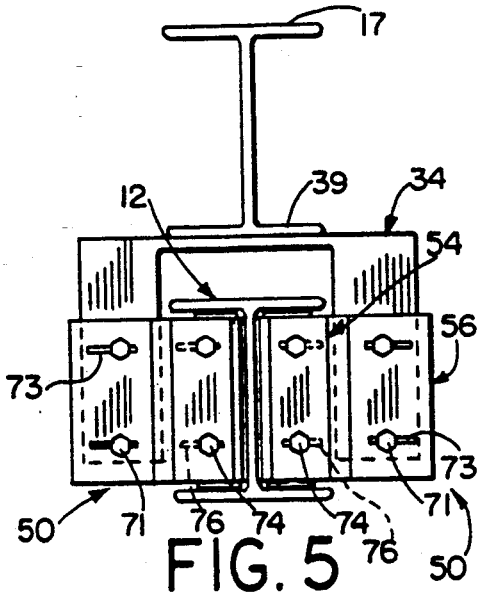
FIG. 5 is an end view of the roller assembly and barnacle removal device taken from the line 5—5 of FIG. 4.
Figure 4:
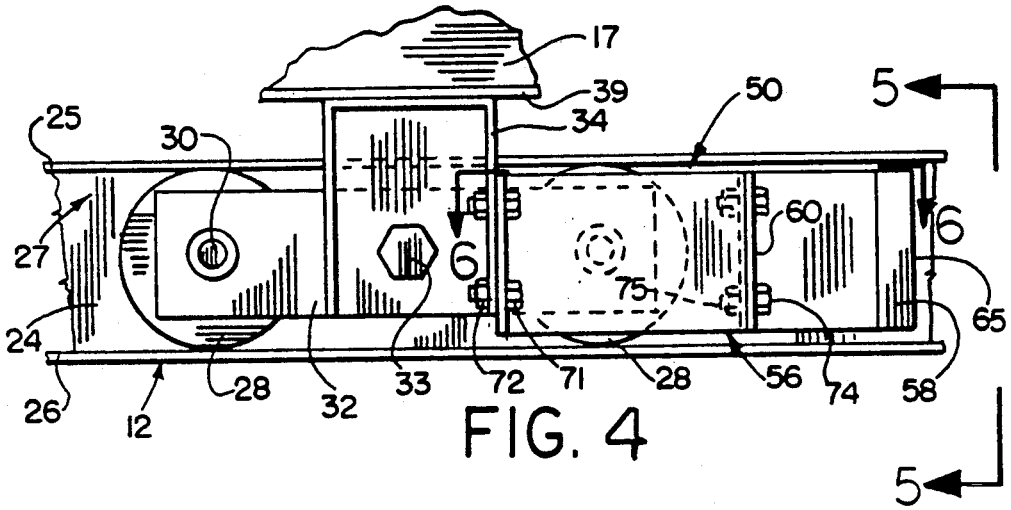
FIG. 4 is a view of the roller assembly in combination with a barnacle removal device according to the present invention.
Figure 6:
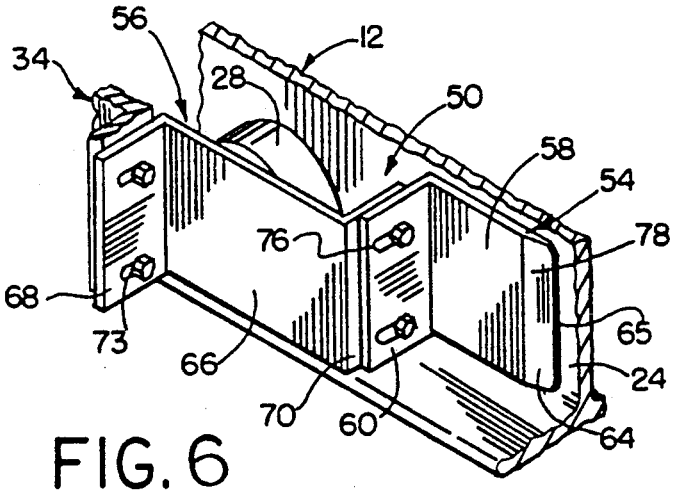
FIG. 6 is a fragmentary perspective view of the roller assembly and barnacle removal device of FIG. 4.

Referring now to FIGS. 4–6, a barnacle removal device according to the present invention is indicated generally at 50 (Two devices 50 are shown in FIG. 5, one at each side of the rail 12). The device 50 includes a blade 54 and a mounting adapter 56. The blade 54 is preferably easily removable from the mounting adapter 56. In this manner, the blade 56 may be replaced with a similar blade, or interchanged for another style of blade. Additionally, the blade 56 may be removed, sharpened and returned for use.

The blade 54 is generally L-shape with a blade portion 58 and a shorter, perpendicular flange 60. The inner surface of the blade portion 58 preferably is smooth and flat for positioning against or closely adjacent the web 24 in substantially parallel relationship. The blade portion 58 has at its distal end, i.e., the end not joined to flange 60, a scraping edge portion 64. The scraping edge portion 64 is of constant width and tapers in thickness toward a knife edge 65 to form a chisel or scraper element. Preferably only the outer side of the blade edge portion is beveled to form the knife edge so that the knife edge will be coplanar with the inner side surface of the blade for positioning against or close to the web of the rail. The knife edge 65 is adjacent the web 24 of the rail 12.

The mounting adapter 56 includes an intermediate planar portion 66 and opposite end flanges 68 and 70 which extend perpendicularly in opposite directions from the planar portion 66. One end flange 68 is secured to the yoke 34 with the planar portion 66 located parallel to and closely adjacent or against the connecting plate 32. In the illustrated embodiment this securement is effected by bolts 71 and nuts 72. Each bolt extends through aligned apertures respectively located in the flange 68 and flange 42 of the yoke as shown, and these apertures in one or both of the flanges may be laterally elongated as illustrated at 73. The elongated aperture or apertures allow the device to accommodate various sizes of boat lift roller assemblies and rails.

As seen in FIGS. 5 and 6 the other end flange 70 of the mounting adapter 56 extends inwardly towards the web 24 of rail 12 for travel in the corresponding track 27. This provides a desirable mount for the blade 56. As shown, the blade flange 60 is secured to the adapter end flange 70 by bolts 74 and nuts 75. The apertures in one or both of the flanges 60 and 70 for the bolts 74 may be elongated, i.e., slots, as illustrated at 76 to allow for adjustment of the blade towards and away from the web 24 of the rail 12.

The blade 54 preferably is adjusted to position the blade portion 58 parallel to and closely adjacent the web 24 of the rail 12. As can be seen in FIGS. 4 and 5, the blade portion at least at its knife edge has a width only slightly less than the spacing between the top and bottom flanges 25 and 26 of the rail for scraping across the full width of the web. Also, the knife edge 65 extends essentially perpendicular to the movement direction of the roller assembly 16 to which the barnacle removal device 50 is attached.

With the blade 54 mounted to a roller assembly 16 as above described, movement of the roller assembly to the right in FIG. 4 will cause the blade to move ahead of the leading roller of the roller assembly. As a result, the blade will engage any barnacles built up on the web 24 of the rail 12 before the roller and effect their removal by scraping them off the web with a chisel-like action. The scraping need not be complete, it being sufficient to remove enough of the buildup to permit relatively unrestricted passage of the leading roller and consequently the trailing roller at the side of the rail equipped with the removal device. As the blade shaves the barnacles from the web, the barnacles will engage the beveled outer surface 78 of the blade portion 58 and thereby urge the blade portion towards the web.

Preferably a removal device 50 is mounted to both sides of the roller assembly 16 for clearing barnacles from both sides of the web 24. Moreover, each roller assembly of the boat lift 10 may be equipped with a pair of removal devices in the manner shown in FIG. 5. However, it usually will be sufficient to equip only the lowermost roller assembly associated with each rail as such will clear away the barnacles for the other assembly or assemblies as the elevator is lowered into the water. The removal devices also may be provided at the upper end of each roller assembly, but this usually will not be necessary as the elevator will normally be stored out of the water so that scraping of the rails will normally be needed only when the elevator is lowered into the water. It perhaps should be noted here that the adapter and blade have symmetry along a longitudinal center line whereby they may be mounted interchangeably on either side of the roller assembly, or even at either end of the roller assembly.

Figure 7:
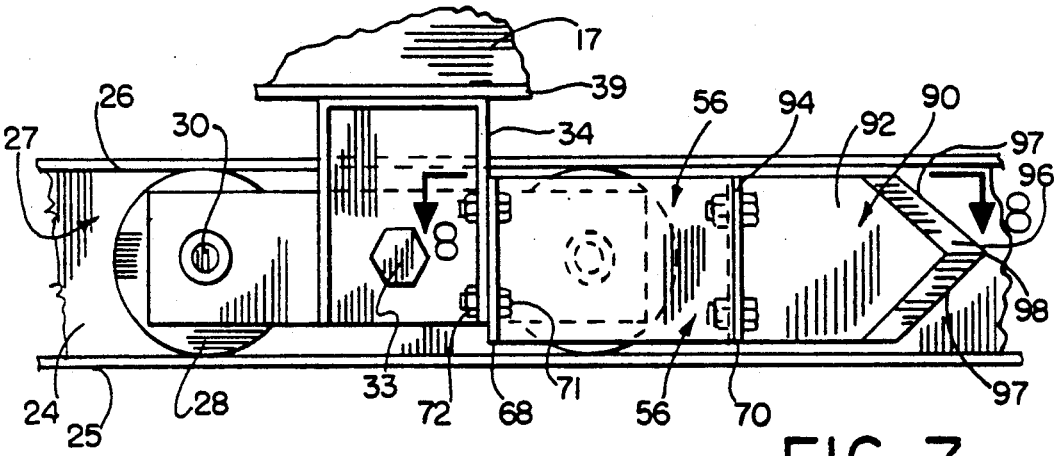
FIG. 7 is a side elevational view similar to FIG. 4 but showing a different form of blade in the barnacle removal device.
Figure 8:
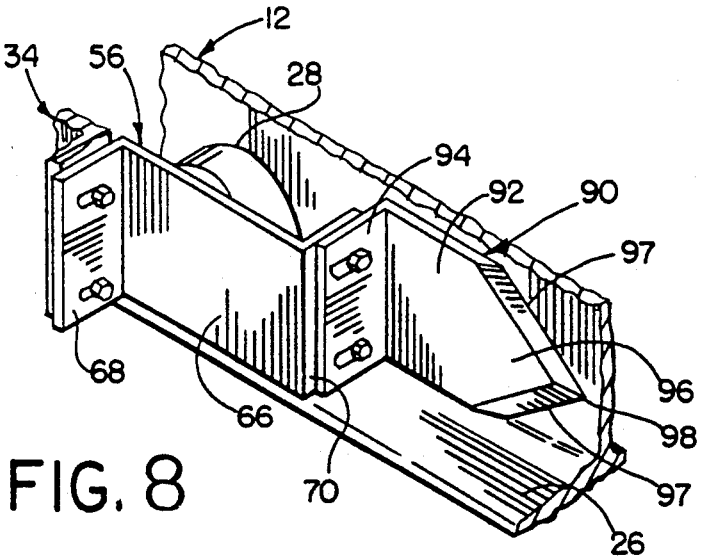
FIG. 8 is a fragmentary perspective view of the roller assembly and barnacle removal device of FIG. 7.

Referring now to FIGS. 7 and 8, a different blade 90 is shown attached to the mounting adapter 56. Like the blade 54, the blade 90 is generally L-shape and has a blade portion 92 and a mounting flange 94. The leading edge portion 96 of the blade portion, however, is configured differently. The leading edge portion 96 has an arrowhead shape with tapered side edges 97 joining at a point 98.

Accordingly, the side edges are skewed in relation to the longitudinal extent of the rail. The side edges 97 preferably are knife edges formed by bevels on the outer side of the blade as shown.

As will be appreciated, the invention may be practiced with still other forms of blades. Moreover, other modifications may be made. For example, the blade and mounting adapter may be formed as a single piece or the blade may be adapted to attach directly to the roller assembly.

One may now appreciate that the present invention permits the removal of barnacles from the rails of a boat lift essentially automatically when the elevator descends down the rails. Thus, a barnacle removal device installed on a boat lift according to the invention minimizes inoperability of the boat lift due to barnacle buildup. The barnacle buildup is removed without having to manually remove the barnacles with a hammer or chisel. Moreover, existing boat lifts may be easily retrofitted with the barnacle removal device because of its simple construction and mounting requirements.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A barnacle removal device for a boat lift having at least one rail and an elevator which rides on the rail, said device comprising:

blade means for removing barnacles from the rail of the boat lift; and mounting adapter means for connecting said blade means to the elevator of the boat lift at a position adjacent the rail for effecting removal of barnacles accumulated on the rail during movement of the elevator;

said blade means being removably attached to said mounting adapter, said blade means being generally L-shape and including a blade portion forming one leg of the L and a perpendicular mounting flange at one end of said blade portion forming the other leg of the L, and said blade portion having a knife edge located at an end thereof opposite said one end.

2. A barnacle removal device for a boat lift having at least one rail and an elevator which rides on the rail, said device comprising:

a blade, and a mounting adapter for connecting said blade to the elevator at a position adjacent the rail for effecting removal of barnacles accumulated on the rail during movement of the elevator, said blade being removably attached to said mounting adapter, said blade being generally L-shape and including a blade portion and a perpendicular mounting flange at one end of said blade portion, said blade portion having a knife edge located at an end thereof opposite said one end, said mounting adapter including an intermediate planar portion parallel to said blade portion of said blade, a first flange extending perpendicularly from one end of said planar portion in a first direction, and a second flange extending perpendicularly from an opposite end of said intermediate planar portion and extending in a direction opposite said first direction, said first flange being connected to said blade, and said second flange being connectable to the elevator.

3. A barnacle removal device for a boat lift having at least one rail and an elevator which rides on the rail, said device comprising:

blade means for removing barnacles from the rail of the boat lift; and mounting adapter means for connecting said blade means to the elevator of the boat lift at a position adjacent the rail for effecting removal of barnacles accumulated on the rail during movement of the elevator;

said blade means having an edge portion which tapers towards a thin edge to form a chisel, and said thin edge being formed by a bevel on only one side of said edge portion.

4. In combination, a boat lift and a device for removing barnacles from said boat lift, said boat lift comprising at least one rail and an elevator having at least one roller riding on said rail, said rail having a web and at least one flange on which said at least one roller of said elevator rides; and said device comprising a blade and means for securing said blade to said elevator at a position adjacent the web of said rail for effecting removal of barnacles accumulated on said web of said rail during movement of said elevator along said rail.

5. A combination as set forth in claim 4, wherein said boat lift further comprises at least one roller assembly riding on said rail and including said at least one roller, a boat cradle, and a yoke securing said roller assembly to said boat cradle, and wherein said means for securing includes a mounting adapter attached to said yoke.

6. A combination as set forth in claim 5, wherein said rail is formed by an I-beam having said web and two flanges including said at least one flange, said flanges forming two symmetrical tracks at opposite sides of said web, said roller assembly including at least one roller positioned on each side of said web for movement in said tracks, and said blade having a blade edge positioned adjacent said web for removing barnacles from said web.

7. A combination as set forth in claim 5, wherein said blade is removably attached to said mounting adapter.

8. A combination as set forth in claim 7, wherein said blade is generally L-shaped and has a blade portion, a perpendicular flange at one end of said blade portion and a knife edge at an opposite end of said blade portion; and said perpendicular flange is secured to said mounting adapter.

9. A combination as set forth in claim 8, wherein said blade portion is positioned adjacent said web of said rail.

10. A combination as set forth in claim 4, wherein said blade has a knife edge.

11. A combination as set forth in claim 10, wherein said knife edge is straight and perpendicular to said rail.

12. A combination as set forth in claim 10, wherein said knife edge is skewed in relation to the longitudinal extent of said rail.

13. A combination as set forth in claim 10, wherein said knife edge has an arrowhead shape.

14. In combination, a boat lift and a device for removing barnacles from said boat lift, said boat lift comprising at least one rail and an elevator riding on said rail, and said device comprising a blade and means for securing said blade to said elevator at a position adjacent to the rail for effecting removal of barnacles accumulated on said rail during movement of said elevator along said rail, said elevator comprising at least one roller assembly riding on said rail, a boat cradle, and a yoke securing said roller assembly to said boat cradle, said means for securing including a mounting adapter attached to said yoke, said blade being removably attached to said mounting adapter, said blade being generally L-shaped and having a blade portion, a perpendicular flange at one end of said blade portion and a knife edge at an opposite end of said blade portion, said perpendicular flange being secured to said mounting adapter, said blade portion being positioned adjacent said web of said rail, said mounting adapter including an intermediate planar portion positioned parallel to said blade portion of said blade, a first flange extending perpendicularly from one end of said intermediate planar portion in a direction toward said web, and a second flange extending perpendicularly from an opposite end of said intermediate planar portion away from said web, said first flange being connected to said perpendicular flange of said blade, and said second flange being connected to said yoke.

* * * * *